US005979201A

United States Patent [19]

Horton et al.

[11] Patent Number: 5,979,201

[45] Date of Patent: Nov. 9, 1999

[54] HYDROFORMING DIE ASSEMBLY FOR PINCH-FREE TUBE FORMING

[75] Inventors: Frank A. Horton, Rochester Hills; Andreas G. Janssen, Sterling Heights; James M. Cross, Oxford, all of Mich.

[73] Assignee: Cosma International Inc., Ontario, Canada

[21] Appl. No.: 08/915,910

[22] Filed: Aug. 21, 1997

Related U.S. Application Data

[60] Provisional application No. 60/024,524, Aug. 26, 1996.

[51] Int. Cl.[6] ..... B21D 26/02

[52] U.S. Cl. ..... 72/58; 72/367.1; 72/370.06; 72/370.23

[58] Field of Search ..... 72/54, 57, 58, 72/367.1, 370.06, 370.23; 29/421.01

[56] References Cited

U.S. PATENT DOCUMENTS

| | | | |
|---|---|---|---|
| 3,335,590 | 8/1967 | Early | 72/58 |
| 3,820,369 | 6/1974 | Tominga et al. | 72/58 |
| 4,829,803 | 5/1989 | Cudini . | |
| 5,239,852 | 8/1993 | Roper . | |
| 5,339,667 | 8/1994 | Shah et al. . | |
| 5,735,156 | 4/1998 | Yoshitomi et al. | 72/58 |

FOREIGN PATENT DOCUMENTS

| | | | |
|---|---|---|---|
| 63-220929 | 9/1988 | Japan | 72/58 |
| 763017 | 9/1980 | U.S.S.R. | 72/58 |

*Primary Examiner*—David Jones
*Attorney, Agent, or Firm*—Pillsbury Madison & Sutro LLP

[57] ABSTRACT

A die assembly having die structures that are cooperable to define a die cavity into which a metallic tubular blank can be disposed. A first die structure is moveable to seal the die cavity, and after the die cavity is sealed, the first and second die structures are moveable to reduce the cross-sectional area of the die cavity and thereby deform the metallic tubular blank within the die cavity.

31 Claims, 5 Drawing Sheets

HYDROFORMING DIE ASSEMBLY FOR PINCH-FREE TUBE FORMING

This application claims the benefit of priority from provisional application No. 60/024,524, filed Aug. 26, 1996.

BACKGROUND OF THE INVENTION

The present invention relates generally to hydroforming die assemblies, and more particularly to a hydroforming die assembly which prevents the metallic tubular blank to be hydroformed from being pinched during closure of the die assembly.

Hydroforming methods are commonly known as a means for shaping a tubular metal blank into a tubular component having a predetermined desired configuration. In particular, a typical hydroforming operation involves the placement of a tubular metal blank into a hydroforming die cavity and providing high pressure fluid to the interior of the blank to cause the blank to expand outwardly into conformity with the surfaces defining the die cavity. More particularly, the opposite longitudinal ends of the tubular metal blank are sealed, and high pressure water is provided through a hydroforming port or ram sealing one of the tubular ends. The fluid provided within the tube is pressurized by a conventional intensifier.

Typically, the die assembly includes a lower die half and an upper die half. The upper die half moves downwardly to cooperate with the lower die half to form the sealed die cavity therebetween. The tubular metal blank is placed in the lower die half before the upper die half is lowered to seal the tubular blank within the cavity.

For many applications, the tubular blank, which typically has a circular cross-section, is hydroformed into a tubular part or component having a boxed or rectangular cross-section as defined by the die cavity. Because the circumference of the tubular blank is significantly less than the circumference or cross-sectional perimeter of the surfaces defining the die cavity, it is often desirable to slightly crush or deform the tubular blank within the die cavity as the upper die half is lowered to seal the die cavity. The desirability of slightly deforming the tubular blank within the die cavity prior to pressurizing the tube for expansion stems, in part, from the need to conform the cross-sectional perimeter of the tubular blank more closely to the cross-sectional perimeter or circumference of the surfaces defining the die cavity to alleviate some of the need to expand or stretch the metal material of the tubular blank during the pressurizing phase of the hydroforming operation. In addition, providing a tubular blank with a cross-sectional perimeter which more closely conforms to that of the die cavity (which can be viewed as providing some "slack" in the metal material for facilitating expansion thereof into conformity with the die cavity) facilitates the ability for expansion of the tubular blank into the "hard" corners of the die cavity.

A problem encountered during the deformation of the tubular blank upon closure of the die cavity is the possibility of the deformed tubular blank to become pinched between the upper and lower die halves as the die cavity is sealed. One solution to this potential problem is discussed in U.S. Pat. No. 4,829,803. This patent discusses an arrangement wherein the tubular blank must be pressurized sufficiently prior to lowering the upper die half, and the exterior surface of the blank must be smoothed sufficiently, such that the internal pressure within the tubular blank prior to the upper die half being closed is at least sufficient to overcome the frictional forces exerting on the blank by the die sections on closing of the die sections. This construction places a degree of criticality on the internal pressure within the tubular blank and the smoothness of various friction surfaces. In addition, because the die assembly deforms the tube before the die cavity is sealed, the pinching problem remains a possibility.

An alternate proposal in U.S. Pat. No. 5,339,667 likewise requires deformation of the tubular blank prior to sealing of the die cavity. This, again, creates the possibility of pinching the tube upon closure of the die cavity. In addition, this patent provides a die cavity with very specific contours to take into account the possibility of pinching the tubular blank. Thus, only limited shapes of tubular components can be formed by this process.

U.S. Pat. No. 5,239,852 provides yet another proposal to solving this problem. However, in this arrangement two die structures must come together with a very high degree of precision to make certain that each of the side walls of the die cavity come into close proximity with sealing surfaces of the opposing die structure. In addition, this construction provides a severely acute angle at the transition between the ledge and heel of the die structures. This corner, formed at such an acute angle, provides a relatively weak portion of the die structure which may be subject to chipping or cracking after prolonged use.

It is object of the invention to overcome the difficulties in the prior art noted above. The present invention accomplishes this by providing at least three separate die structures cooperable to define a die cavity into which a metallic tubular blank can be disposed. The first die structure is moveable to seal the die cavity, and after the die cavity is sealed, the first and second die structures are moveable to reduce the cross-sectional area of the die cavity and thereby deform the metallic tubular blank within the die cavity.

Also in accordance with the present invention, two moveable die structures and a single fixed die structure are provided to define the die cavity. Relative movement between the first and second movable structures seals the cavity. After the cavity is sealed, movement of the first die structure relative to the fixed die structure reduces the cross-sectional area of the die cavity to deform the metal tube in the die cavity.

It is a further object of the present invention to provide a method of hydroforming a metallic tube. The method comprises placing the metallic tube in a hydroforming die assembly having three separate die structures, the three die structures being cooperable to define a die cavity; moving a first one of the die structures to seal the die cavity; then moving the first one of the die structures and a second one of the die structures to reduce the cross-sectional area of the die cavity; and deforming the metallic tube as a result of reducing the cross-sectional of the die cavity.

A further object of the invention is to provide a hydroforming die assembly comprising a lower die assembly defining a lower die cavity portion into which a metallic tube can be placed, the lower die assembly providing side walls defining opposite sides of the lower die cavity portion, and a lower wall defining a lower surface of the lower die cavity; an upper movable die structure having sealing surfaces which are movable to engage the lower die assembly on opposite sides of the lower die cavity portion to seal the lower die cavity portion and thereby provide a sealed die cavity; the lower die assembly and the upper die structure being cooperable to reduce a size of the sealed die cavity to deform the metallic tube after the die cavity is sealed.

Other objects and advantages of the present invention will be realized in accordance with the following detailed description, appended drawings and claims.

DETAILED DESCRIPTION OF THE PREFERRED EMBODIMENTS ILLUSTRATED IN THE DRAWINGS

Figure 1:
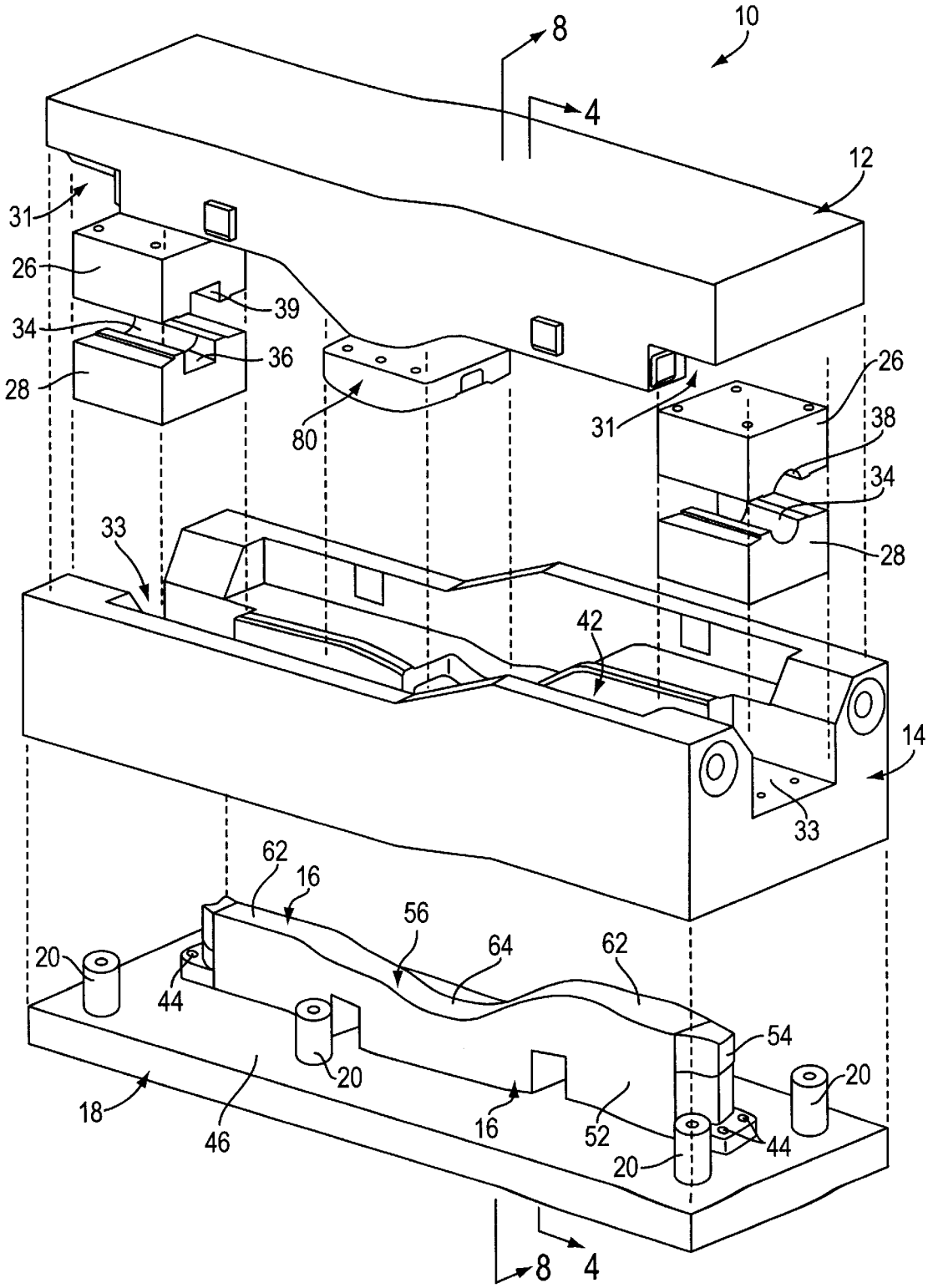
FIG. 1 is an exploded perspective view of the hydroforming die assembly in accordance with the present invention.

Shown generally in FIG. 1 is an exploded view of a hydroforming die assembly, generally indicated at 10, in accordance with the present invention. The hydroforming die assembly 10 generally includes a movable upper die structure 12, a movable lower die structure 14, a fixed die structure 16, a fixed base 18 to which the fixed die structure 16 is to be fixed, and a plurality of commercially available nitrogen spring cylinders 20 for mounting the lower die structure 14 for movement on the fixed base 18. The upper die structure 12, lower die structure 14, and fixed die structure 16 cooperate to define a longitudinal die cavity therebetween having a substantially box-shaped cross section, as will be described in greater detail in conjunction with FIGS. 5–7. Preferably, the upper die structure 12, lower die structure 14, fixed die structure 16, and fixed base are each made of an appropriate steel material, such as P-20 steel.

Figure 2:
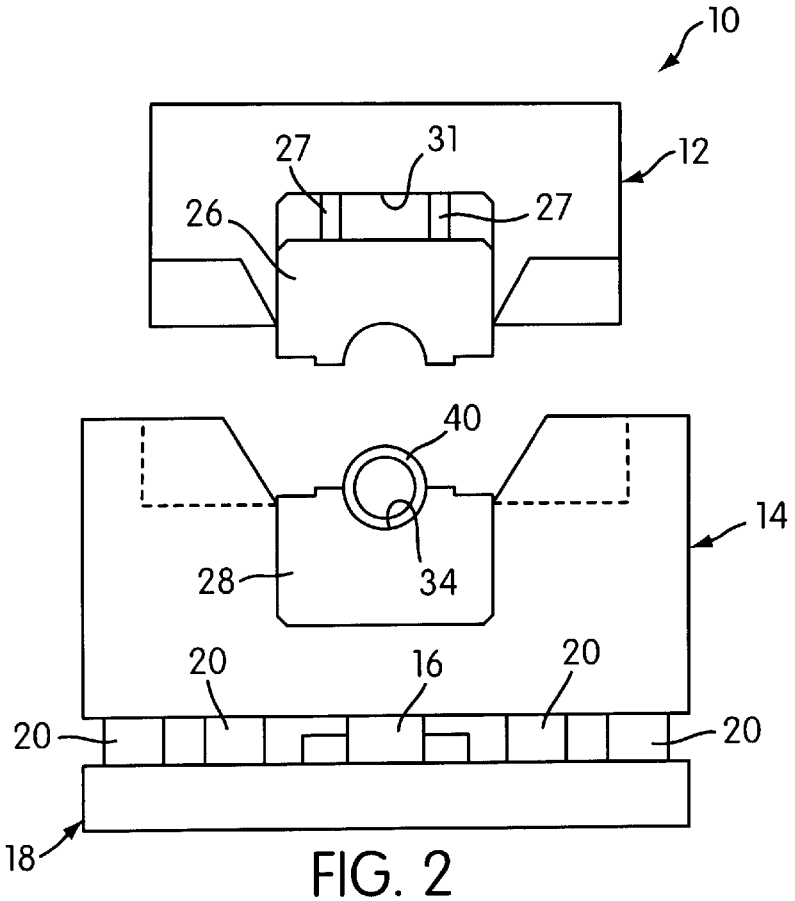
FIG. 2 is a plan view of one longitudinal end of the hydroforming die assembly of the present invention, with the upper die structure shown in a raised or opened position.

As shown in FIG. 1, the upper die structure 12 has a pair of cradle areas 31 at opposite longitudinal ends thereof. The cradle areas 31 are shaped and arranged to receive and accommodate upper clamping structures 26 at opposite longitudinal ends of the upper die structure 12. Particularly, the clamping structures 26 are each connected to the upper die structure 12 at the respective cradle areas 31 by a plurality of nitrogen spring cylinders which permit relative vertical movement between the clamping structures 26 and the upper die structure 12. For example, as shown in FIG. 2, nitrogen spring cylinders 27 mount the clamping structures 26 in slightly spaced, resiliently biased relation with respect to upper die structure 12.

The lower die structure 14 has similar cradle areas 33 at opposite longitudinal ends thereof which are constructed and arranged to accommodate lower clamping structures 28 in similar fashion.

The lower clamping structures 28 each have a longitudinally extending, generally arcuate or semicircular, upwardly facing surface 34. The surfaces 34 are constructed and arranged to engage and cradle the underside of a tubular blank placed in the lower die structure. As each of the arcuate surfaces 34 in the lower clamping structures 28 extend longitudinally inwardly towards the central portions of the hydroforming die assembly 10, they transition into a substantially squared or boxed U-shaped surface configuration 36.

The upper tube clamping structures 26 are substantially identical to the lower clamping structures 28, but are inverted with respect thereto. More particularly, as can be appreciated from FIGS. 1–3, each upper clamping structure 26 has an arcuate or semi-circular longitudinally extending, but downwardly facing surface 38, which transitions into an inverted boxed U-shaped surface configuration 39. The arcuate surface 38 of each clamping structure 26 cooperates with the surface 34 of a respective one of the lower clamping structures 28 to form cylindrical clamping surfaces that capture and sealingly engage the opposite ends of a tubular blank 40 when the upper die structure 12 is initially lowered (see FIG. 3).

Figure 4:
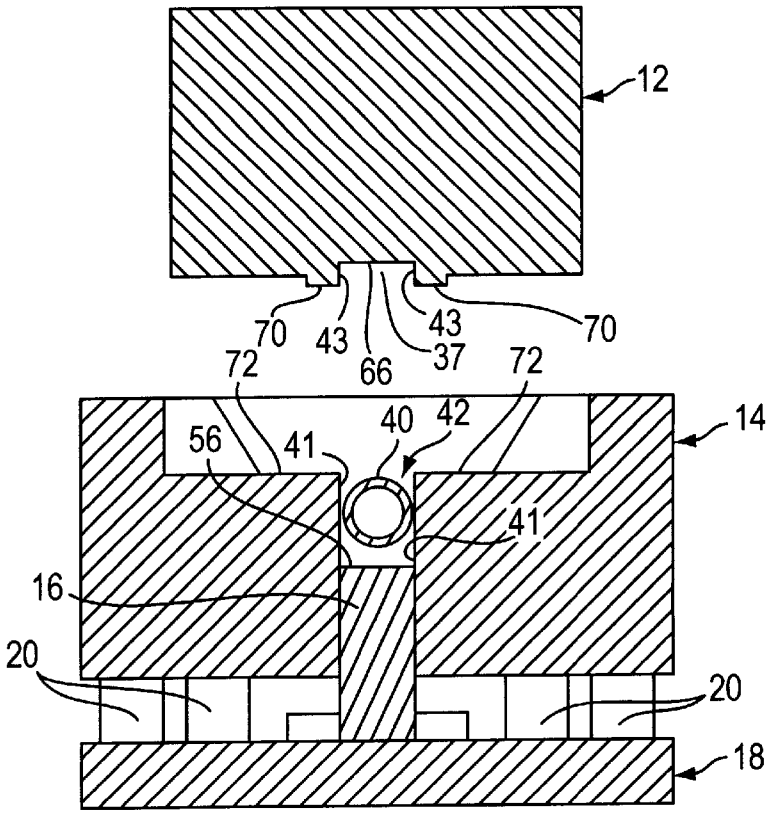
FIG. 4 is a transverse sectional view taken through the line 4—4 in FIG. 1, but showing the components fully assembled, with the upper die structure in the raised or opened position as in FIG. 2.

As can be appreciated from the cross-sectional view of FIG. 4, between the upper cradle areas 31 the upper die structure 12 defines a longitudinal channel 37 having a substantially inverted U-shaped cross-section. The channel 37 is defined by spaced longitudinally extending vertical side surfaces 43 running parallel to one another, and a generally horizontal, longitudinally extending surface 66 therebetween.

Figure 3:
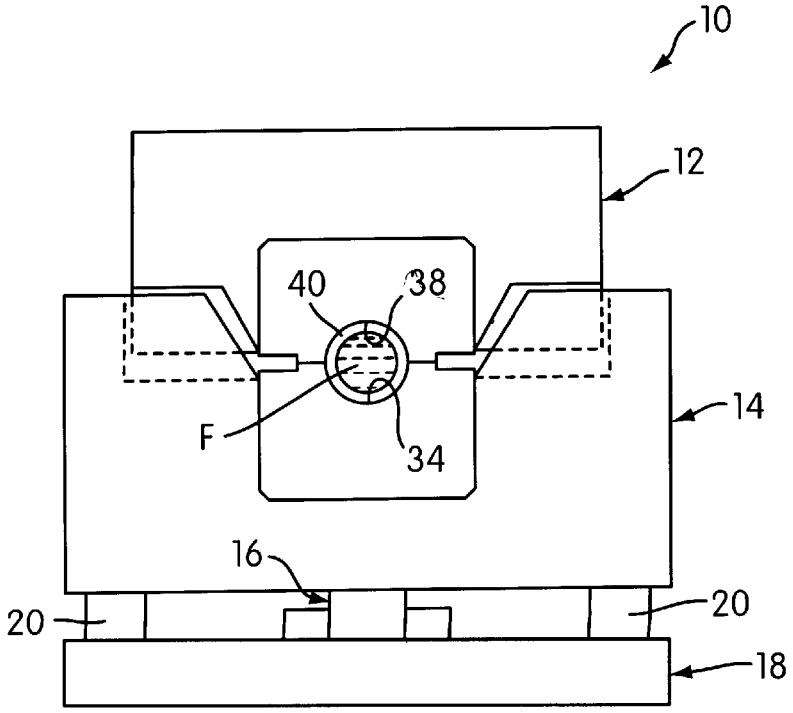
FIG. 3 is a plan view similar to that of FIG. 2, but showing the upper die structure in an initial closed position, prior to the upper die structure being in a fully lowered or closed position.

As can be appreciated from FIG. 1 and the end plan views of FIGS. 2 and 3, the opposite longitudinal ends of the lower die structure 14 which define the cradle areas 33 have a substantially U-shaped cross-section. However, as can be appreciated from the cross-sectional view of FIG. 4, the lower die structure 14 has a central opening 42 therethrough between the U-shaped longitudinal ends. Interior vertical surfaces 41 on the lower die structure 14 define and surround the aforementioned central opening 42 on all four sides. More particularly, a pair of longitudinally extending side surfaces 41 define lateral extremities of the opening 42. These surfaces are vertically disposed and in parallel, facing relation with one another, as can be appreciated from FIGS. 4–7. Although not shown, it can be appreciated that a pair of transverse side surfaces 41 (not shown) define the longitudinal extremities of the opening 42 and are vertically disposed in parallel, facing relation to one another. It can also be appreciated that the four surfaces 41 provide the opening 42 with a substantially rectangular top plan view configuration.

Returning now to FIG. 1, it can be appreciated that the fixed base 18 is in the form of a substantially rectangular metal slab, and that the fixed die structure 16 is fixed to an upper surface 46 of the fixed base 18 by a plurality of bolts 44. The fixed die structure 16 is an elongate structure which extends along a substantial portion of the length of the upper surface 46 of the fixed base 18, generally along the transverse center of the fixed base 18. The fixed die structure 16 projects upwardly from the fixed base 18 and has substantially vertical side surfaces 52 on opposite longitudinal sides thereof (only one of such side surfaces being shown in FIG. 1). The fixed die structure 16 also has substantially vertical end surfaces 54 at opposite longitudinal ends thereof (only one of such side surfaces being shown in FIG. 1). The fixed die structure 16 is constructed and arranged to extend within the opening 42 in the lower die structure 14 with minimal clearance between the generally vertical surfaces 41 defining the opening 42 and the vertical side surfaces 52 and 54 of the fixed die structure 16. The fixed die structure 16 further includes an upper, generally horizontal, longitudinally extending die surface 56, which is constructed and arranged to extend in spaced relation to the longitudinally extending die surface 66 on the upper die structure 12.

Preferably, the cooperation between the aforementioned side surfaces 41, the upper surface 56 and surfaces 43 of the fixed die structure 16, and the lower surface 66 of the upper die structure 12 cooperate to provide a die cavity 60 having a generally box-shaped cross-sectional configuration substantially throughout its longitudinal extent (see FIGS. 5 and 6), to form a hydroformed part having a substantially closed box cross-sectional configuration throughout its longitudinal extent. The die surface 56 of the fixed die structure 16 and the die surface 66 of the upper die structure 12 provide the lower and upper die surfaces, respectively, of the die cavity 60. Referring back to FIG. 1, it can be appreciated that although the upper surface 56 of fixed die structure 16 is referred to above as being generally horizontal, and indeed has substantially horizontal and generally parallel surface portions 62 at opposite longitudinal ends thereof, an arcuate, downwardly extending surface portion 64 is disposed therebetween. It can thus be appreciated that the tubular hydroformed part can be provided with an irregular configuration if desired.

FIG. 2 is an end plan view of the hydroforming die assembly 10, with the upper die structure 12 in an opened or raised position. In this position, the hydroforming die assembly 10 enables a tubular blank 40 to be placed within the lower die structure 14. The blank 40 is preferably pre-bent at an intermediate portion thereof before it is placed in the lower die structure 14. The pre-bent configuration of the blank 40 generally follows the contour of the curved opposing die surfaces 56 and 66. It can be appreciated from FIGS. 1, 4, and 5 that the tubular blank 40 to be hydroformed is suspended by the lower clamping structures 28 to extend slightly above the upper surface 56 of the fixed die structure 16 when the tubular blank 40 is first placed in the hydroforming die assembly 10.

Figure 8:
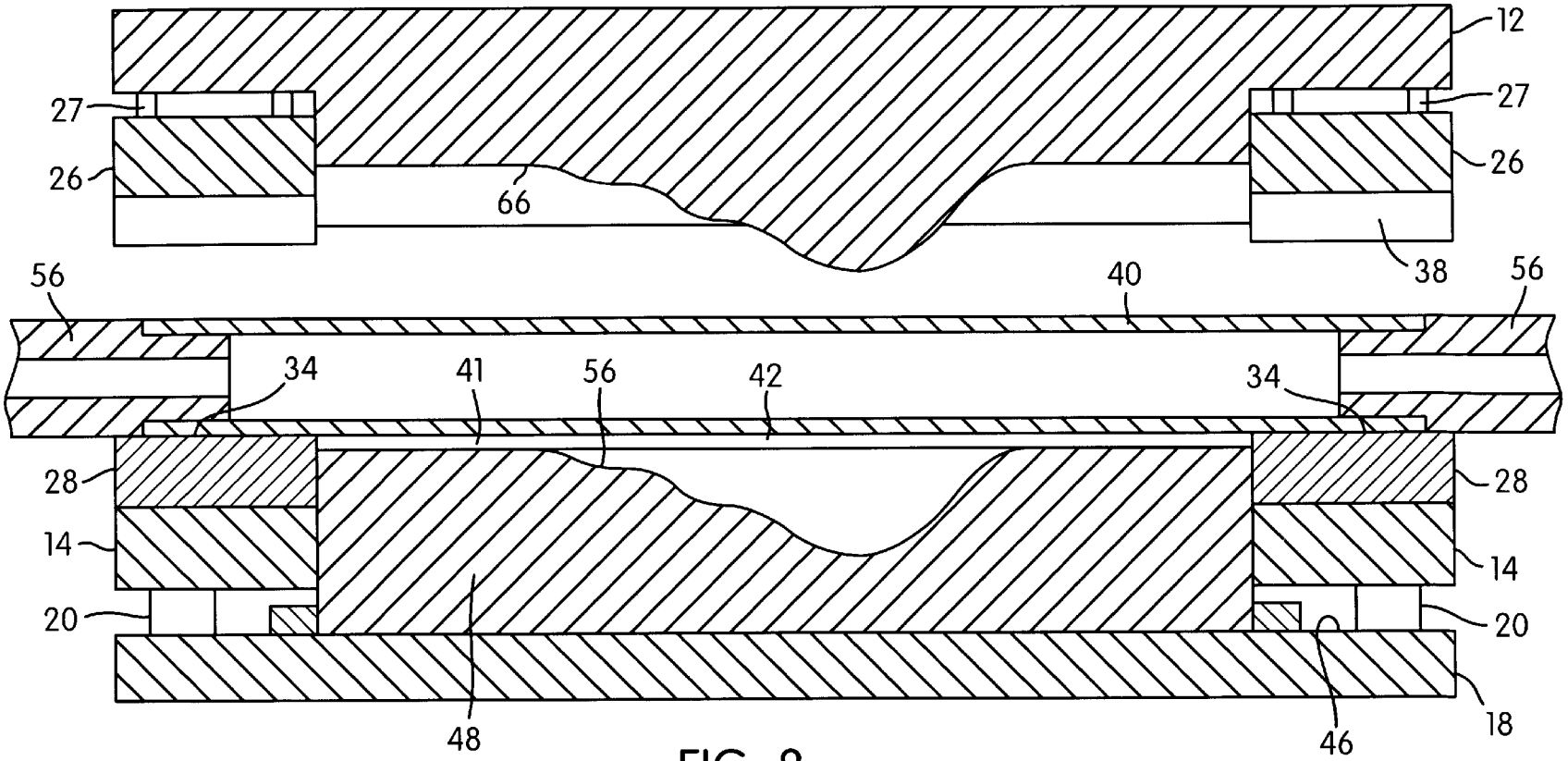
FIG. 8 is a longitudinal sectional view taken through the line 8—8 in FIG. 1, but showing the components fully assembled, with a tubular blank disposed in the lower die assembly, a pair of hydraulic rams engaging opposite ends of the tubular blank, and the upper die structure in a raised position.

When the blank is placed in the lower die structure 14, opposite ends of the blank 40 rest upon the respective surfaces 36 of the lower clamping structures 28 at opposite ends of the lower die structure 14 (see FIG. 8). Preferably, the surfaces 36 are constructed and arranged to form an interference fit with the lower portion of the respective opposite ends of the tubular blank 40. Subsequently, the upper die structure is lowered so that the upper clamping structures, which are held in the extended position by nitrogen cylinders 27 as shown in FIG. 2, form an interference fit with the upper portion of the respective opposite ends of the tubular blank 40. At this point, both opposite ends of the tubular blank are captured between clamps 26 and 28 before the upper die structure 12 is lowered to its fully closed position.

At this point, the tubular blank 40 is substantially rigidly held in place to permit hydroforming cylinders, indicated at 59 in FIG. 8, to be telescopically and sealingly inserted into both opposite ends of the tube 40, without any substantial movement of the tube and without the need to completely lower the upper die structure 12 to its fully closed or lowered position. The hydroforming cylinders preferably pre-fill, but do not pressurize to any large extent, the tubular blank 40 with hydraulic fluid (indicated by reference character F in FIGS. 3, 5, 6 and 7) before or simultaneously with the continued lowering of the upper die structure 12. Preferably, water is used as the hydraulic fluid. Although the pre-filling operation is preferred to reduce cycle times and to achieve a more smoothly contoured part, the present invention contemplates that the upper die structure 12 can be fully lowered before any fluid is provided internally to the tube 40.

Figure 5:
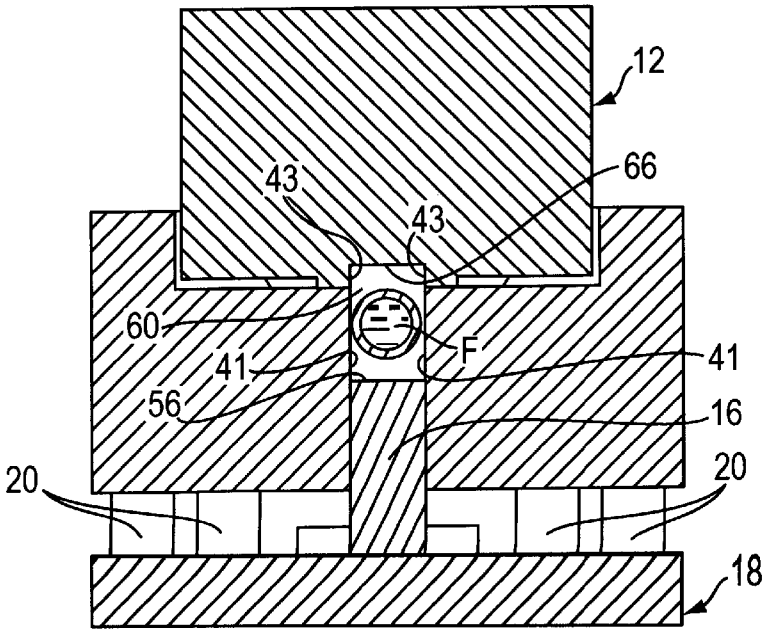
FIG. 5 is a sectional view similar to that shown in FIG. 4, but showing the next step in a hydroforming process in which the upper die structure is in the initial closed position as in FIG. 3.

As shown in FIG. 5, the upper die structure 12 preferably includes a pair of laterally spaced parallel ridges 70 projecting downwardly from opposite sides of the die surface 66 and extend along the entire length of the upper die structure 12. When the upper die structure 12 is lowered further, after the initial engagement of the upper clamping structure 26 with the tube 40 and lower clamping structure 28 (as shown in FIG. 3), the nitrogen cylinders 27 are compressed and the ridges 70 are brought into engagement with upper die surfaces 72 of the lower die structure 12 on opposite sides of the opening 42 so as to seal the die cavity 60 (as shown in FIG. 5). The ridges 70 form a robust seal that can withstand extremely high cavity pressures of over 10,000 atmospheres. It may be desirable to provide similar ridges on die surfaces 72, on opposite longitudinal sides of the opening 42, that cooperate with ridges 70. In any event, because the hydroforming die assembly 10 utilizes three (or optionally more) die structures 12, 14, and 16 to form the die cavity 60, the pinch-free hydroforming die assembly 10 in accordance with the present invention need not be provided with any areas having a thin cross-section that may be vulnerable to chipping or breakage after several hydroforming operations.

After the initial engagement of the ridges 70 with the die surface 72, continued movement of the upper die structure 12 downwardly causes the lower die structure 14 to be forced downwardly therewith against the force of nitrogen spring cylinders 20 on which the lower die structure 14 is mounted. The tube 40, trapped at its ends between the upper die structure 12 and the lower die structure 14, is likewise moved downwardly. The forced downward movement of the lower die structure 14 can be accomplished by using the shear weight of the upper die structure 12, or by providing a hydraulic system that forces the upper die structure 12 downwardly. The upper die structure 12 and lower die structure 14 continue to move downwardly, until such movement is stopped when the lower die structure engages a stop structure provided by the fixed base 18. During this continued downward movement of the upper die structure 12 and lower die structure 14, the die surface 66 of the upper die structure 12 is moved towards the die surface 56 of the fixed die structure 16 so as to reduce the size of the die cavity 60, while maintaining a substantial peripheral seal in the cavity. Eventually, the lower portion of the blank 40 is moved downwardly and engages the die surface 56 of the die structure 16.

Figure 6:
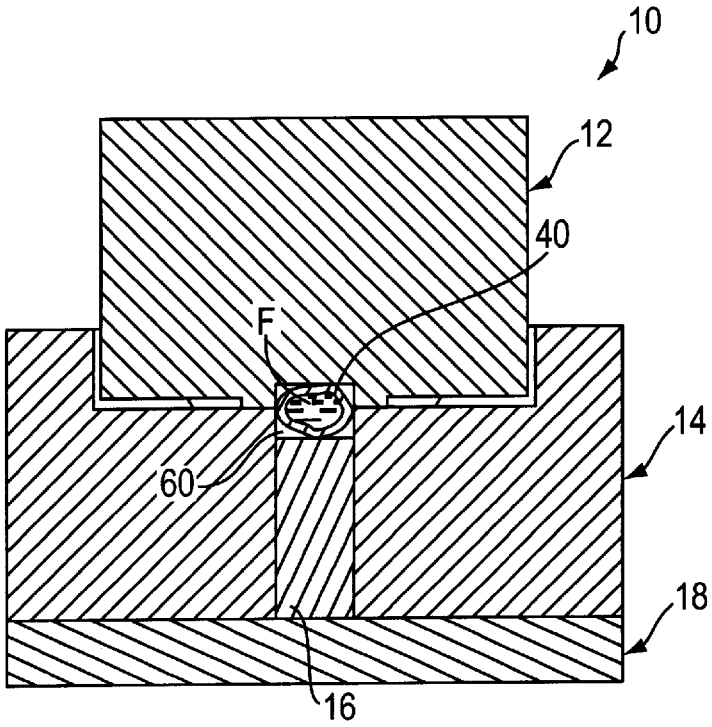
FIG. 6 is a transverse sectional view similar to that shown in FIG. 5, but showing the next hydroforming step in accordance with the present invention, wherein the upper die structure is in the fully lowered position and a tubular blank to be hydroformed is slightly deformed or crushed by relative movement of die structures forming the die cavity in accordance with the present invention.

After the lower portion of blank 40 engages die surface 56, continued downward movement of the die structures 12 and 14 causes the blank 40 to bend. As shown in FIG. 6, when the upper die structure 12 and lower die structure 14 finally come to rest at the fully lowered or closed position, cavity 60 is made sufficiently small such that the tubular blank 40 is slightly crushed. This slight crushing of the tubular blank is performed so that the cylindrical, tubular blank 40 can be provided with a circumference that conforms more closely to the final cross-sectional perimeter of the box-shaped die cavity 60. Because the tubular blank 40 is pre-filled with hydraulic fluid before crushing, wrinkles in the tube as a result of crushing are generally avoided, and a generally smoothly contoured hydroformed part can be formed.

Figure 7:
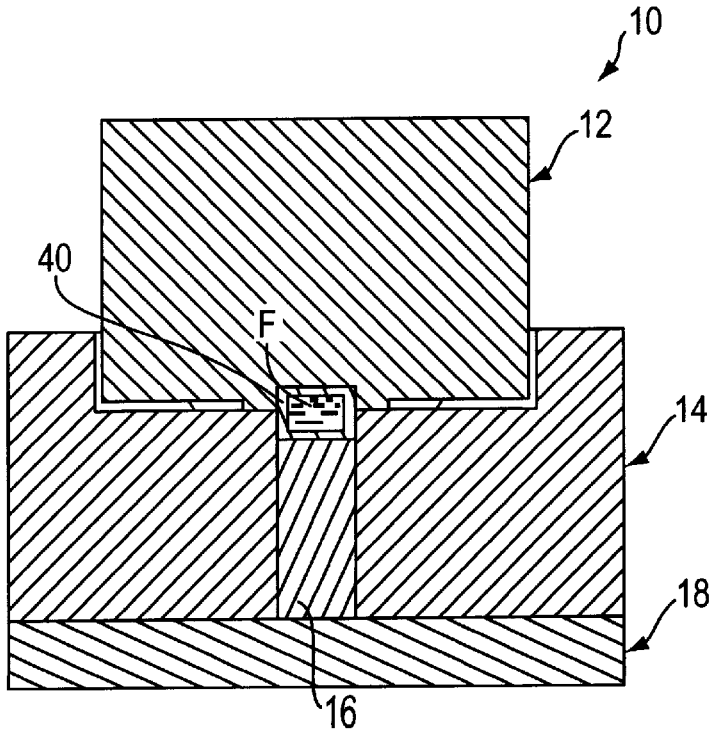
FIG. 7 is a transverse sectional view similar to that in FIG. 6, but showing a subsequent hydroforming procedure in which fluid under pressure expands the tubular blank into conformity with the die cavity.

As shown in FIG. 7, after the upper die structure 12 reaches its fully lowered position, wherein the lower die structure 14 is brought into engagement with the stop surface 46 of fixed base 18 so that it cannot move further, the hydraulic fluid inside the crushed blank 40 is pressurized by the hydraulic system in any known fashion (e.g., by use of a hydraulic intensifier or high pressure pump) through one of the ends of the tubular blank 40. Alternatively, the expansion or hydroforming of the tubular blank 40 can begin prior to full lowering of the upper die structure 12 and thus prior to the crushing of the tubular blank 40. More specifically, the present invention contemplates that expansion of the tubular blank 40 may begin immediately after the upper die structure 12 is lowered to the point that the sealing surface 70 thereof is brought into engagement with the cooperating die surface 72 of lower die structure 14, as shown in FIG. 5. By beginning the expansion at this earlier time, the cycle time for the entire hydroforming procedure can be reduced. Moreover, because the die cavity has a larger cross-sectional area when the clamping structure 26 and upper die structure 12 first engage the lower die structure 14 (see FIG. 5) in comparison to when the die structure 12 and lower die structure 14 are brought to the fully lowered position (see FIG. 6), this earlier expansion of the tubular blank enables the blank to expand radially in a vertical direction (i.e., in an oval configuration) beyond what is possible with the upper die structure 12 in the fully lowered position. As a result of this increased expansion capability, the cross-sectional circumference of the tubular blank 40 can be brought into closer conformity with the final cross-sectional circumference with final die cavity 60, and it becomes easier to expand the tubular blank 40 into the corners of the die cavity. In particular, because the tubular blank 40 is expanded to conform its cross-sectional circumference as aforementioned prior to the tubular blank being engaged by the die surface 66, the tubular blank can be expanded into the corners of the die cavity 60 without having to move the metal material of the blank while the exterior metallic surface of the blank 40 is in frictional engagement with the upper and lower die surfaces 56 and 66. As a result, expansion into the comers of the die cavity 60 is more easily accomplished, and a smoother final part can be formed.

During the hydroforming expansion of the tubular blank 40, the fluid F is pressurized to an extent sufficient to expand the blank radially outwardly into conformity with the die surfaces defining the die cavity 60. Preferably, fluid pressure of between approximately 2,000 and 3,500 atmospheres is used, and the blank is expanded so as to provide a hydroformed part having a cross-sectional area which is 10% or more greater than that of the original blank. In addition, the opposite longitudinal ends of the tubular blank are pushed longitudinally inwardly towards one another to replenish the wall thickness of the tube as it is being expanded, as described in U.S. patent application Ser. No. 08/314,496, filed Sep. 28, 1994, and hereby incorporated by reference. While the blank 40 is pressurized and expanded, the upper die structure 12 continues to be forced downwardly to maintain the shape of the sealed cavity 60, for example by a hydraulically powered piston, to oppose the upward force resulting from pressurizing the tube 40.

After the tube 40 is hydroformed, the upper die structure 12 is raised. Because the hydroformed part is forced into engagement with the peripheral die surfaces forming cavity 60, the part may form a substantially rigid interference fit with surfaces 41 and 43 of the upper die structure 12. In this case, the tube 40 will be lifted upwardly with the upper die structure 12 and must be extracted therefrom. To this end, the upper die structure 12 is provided with an ejection structure 80, shown in FIG. 1. The ejection structure 80 fits within a cradle area in the upper die structure 12 and forms part of the die cavity 60 in continuously contoured fashion. The ejection structure 80 is movable in a vertical direction out of its cradled position in the die structure 12 to effectively eject the hydroformed part. The ejection structure can be moved by virtue of a hydraulic piston.

Similarly, the lower die structure 14 may be provided with a pair of ejection structures (not shown), which fit within the lower die structure to define part of the side surfaces 41 defining the opening 42 in the die structure 14. The ejection structures function to eject the hydroformed part in the event it is wedged or form fitted to the interior die surfaces of lower die structure 14 after a hydroforming operation.

It should be appreciated that the foregoing detailed description and accompanying drawings of the preferred embodiment are merely illustrative in nature, and that the present invention includes all other embodiments that are within the spirit and scope of the described embodiment and appended claims. For example, while the specific illustrated embodiment provides three separate die structures which cooperate to form the die cavity, it can be appreciated that four or more die structures can also be used in keeping within the scope of this invention.

What is claimed is:

1. A hydroforming die assembly comprising:

a first moveable die structure;

a second moveable die structure;

a fixed die structure;

said first moveable die structure, said second moveable die structure, and said fixed die structure being cooperable to define a die cavity into which a metallic tube can be disposed;

wherein relative movement between said first and second moveable die structures seals said die cavity; and wherein, after said die cavity is sealed, movement of said first moveable die structure with respect to said fixed die structure progressively reduces the cross-sectional area of said die cavity to deform said metallic tube within said die cavity.

2. The hydroforming die assembly according to claim 1, further comprising:

hydroforming port members constructed and arranged to provide pressurized fluid to an interior of said metallic tube so as to expand said metallic tube outwardly into conformity with surfaces defining said cavity.

3. The hydroforming die assembly according to claim 2, wherein said hydroforming port members are capable of relative movement therebetween to enable said hydroforming port members to longitudinally compresses said metallic tube therebetween so as to flow metal material of said metallic tube in a longitudinal direction to replenish the wall thickness of the tube as it is being expanded.

4. The hydroforming die assembly according to claim 1, wherein said fixed die structure is received within an opening in said second moveable die structure, and wherein said first die structure moves into engagement with said second die structure to seal said die cavity.

5. The hydroforming die assembly according to claim 4, wherein said second moveable die structure is mounted on a plurality of compressible spring members, wherein said first moveable die structure is moved downwardly into engagement with said second die structure to seal said die cavity, and wherein continued downward movement of said first moveable die structure after said engagement moves said second moveable die structure downwardly therewith against a bias of said spring members, and wherein said continued downward movement of said first moveable die structure and downward movement of said second moveable die structure reduces the cross-sectional area of said die cavity to deform said metallic tube.

6. A hydroforming die assembly according to claim 5, wherein said compressible spring members comprise nitrogen spring cylinders.

7. A hydroforming die assembly according to claim 5, further comprising a pair of opposing lower clamp structures mounted on said second moveable die structure and constructed and arranged to engage an underside of said metallic tube at opposite longitudinal ends thereof, and wherein said lower clamp structures suspend said metallic tube in overlying relation to said fixed die structure prior to said first moveable die structure moving downwardly into engagement with said second moveable die structure.

8. A hydroforming die assembly according to claim 7, wherein said lower clamp structures are mounted on said second moveable die structure by spring cylinders to enable relative movement between said lower clamp structures and said second moveable die structure.

9. A hydroforming die assembly according to claim 7, wherein said lower clamp structures form an interference fit with opposite longitudinal ends of said metallic tube.

10. A hydroforming die assembly according to claim 8, further comprising a pair of opposing clamp structures mounted on said first moveable die structure and constructed and arranged to engage an upper surface of said metallic tube at opposite longitudinal ends when said first moveable die structure moves into engagement with said second die structure, said opposing clamp structures mounted on said first moveable die structure cooperating with said lower clamp structures mounted on said second moveable die structure to capture the exterior surface of said metallic tube at opposite ends.

11. A hydroforming die assembly comprising:

a first die structure;

a second die structure;

a third die structure;

said first die structure, said second die structure, and said third die structure being cooperable to define a die cavity into which a metallic tube can be disposed;

said first die structure being moveable to seal said die cavity; and wherein after said die cavity is sealed, said first and second die structures are moveable to reduce a cross-sectional area of said die cavity to deform said metallic tube within said die cavity.

12. A hydroforming die assembly according to claim 11 wherein said second die structure remains stationary as said first die structure is moved to seal said die cavity.

13. A hydroforming die assembly according to claim 12, wherein said third die structure remains fixed as said first and second die structures move to progressively reduce the cross-sectional area of said die cavity.

14. The hydroforming die assembly according to claim 11, further comprising:

hydroforming port members constructed and arranged to provide pressurized fluid to an interior of said metallic tube so as to expand said metallic tube outwardly into conformity with surfaces defining said cavity.

15. The hydroforming die assembly according to claim 14, wherein relative movement between said hydroforming port members longitudinally compresses said metallic tube therebetween so as to flow metal material of said metallic tube in a longitudinal direction to replenish the wall thickness of the tube as it is being expanded.

16. The hydroforming die assembly according to claim 11, wherein said die structure is received within an opening in said second moveable die structure, and wherein said first die structure moves into engagement with said second die structure to seal said die cavity.

17. The hydroforming die assembly according to claim 16, wherein said second die structure is mounted on a plurality of compressible spring members, wherein said first die structure is moved downwardly into engagement with said second die structure so that continued downward movement of said first moveable die structure after said engagement moves said second die structure downwardly therewith against a bias of said spring members, and wherein said continued downward movement of said first die structure and downward movement of said second moveable die structure reduces the cross-sectional area of said die cavity.

18. A hydroforming die assembly according to claim 17, wherein said compressible spring members comprise nitrogen spring cylinders.

19. A method of hydroforming a metallic tube comprising:

placing the metallic tube in a hydroforming die assembly having three separate die structures, said three die structures being cooperable to define a die cavity;

moving a first one of said die structures to seal said die cavity;

then moving said first one of said die structures and a second one of said die structures to reduce a cross-sectional area of said die cavity; and deforming said metallic tube as a result of reducing the cross-sectional area of said die cavity.

20. The method according to claim 19, further comprising:

providing fluid pressure to an interior of said metallic tube prior to deforming said metallic tube so as to provide internal support to said metallic tube as it is deformed.

21. A hydroforming die assembly comprising:

a lower die assembly defining a lower die cavity portion into which a metallic tube can be placed, said lower die assembly providing side walls defining opposite sides of said lower die cavity portion, and a lower wall defining a lower surface of said lower die cavity portion;

an upper movable die structure having sealing surfaces which are movable to engage portions of said lower die assembly on opposite sides of said lower die cavity portion to seal said lower die cavity portion and thereby provide a sealed die cavity;

said lower die assembly and said upper die structure being cooperable to reduce a size of said sealed die cavity to deform said metallic tube after said die cavity is sealed;

said lower die assembly further comprising a fixed stop surface different from said portions of said lower die assembly which engage said sealing surfaces of said upper die structure, said fixed stop surface stopping movement of said upper die structure after said die cavity is sealed and said sealed die cavity has been reduced in size, said sealing surfaces engaging said portions of said lower die assembly to seal said die cavity before said fixed stop surface stops movement of said upper die structure.

22. A hydroforming die assembly according to claim 21, wherein said lower die assembly comprises a lower moveable die structure and a fixed die structure.

23. A hydroforming die assembly according to claim 22, wherein said stop surface is provided on said fixed die structure.

24. A hydroforming die assembly according to claim 22, wherein said upper die structure engages said lower moveable die structure to seal said die cavity.

25. A hydroforming die assembly according to claim 23, wherein said upper die structure engages said lower moveable die structure to seal said die cavity.

26. A hydroforming die assembly according to claim 22, wherein said lower moveable die structure moves together with said upper die structure after said sealing surfaces engage said portions of said lower die assembly.

27. A hydroforming die assembly according to claim 21, wherein said side walls include first and second opposing side walls, and wherein said sealed die cavity is established by said lower surface, said first side wall, said second side wall, and a surface of said upper die structure, at least one of which is moveable relative to others to reduce the size of said sealed die cavity after said sealing surfaces of said upper moveable die structure have been moved into engagement with said portions of said lower die assembly.

28. A hydroforming die assembly according to claim 21, wherein said portions of said lower die assembly on opposite sides of said lower die cavity are generally horizontally disposed.

29. A hydroforming die assembly according to claim 21, wherein movement of said sealing surfaces to engage said portions of said lower die assembly comprises movement of said sealing surfaces in a direction generally perpendicular to a plane of said sealing surfaces.

30. A hydroforming die assembly according to claim 29, wherein engagement of said sealing surfaces with said portions of said lower die assembly comprises contact therebetween which prevents relative movement therebetween.

31. A method of hydroforming a metallic tube comprising:

placing the metallic tube in a lower die cavity portion of a lower die assembly;

said lower die assembly providing side walls defining opposite sides of said lower die cavity portion and a lower wall defining a lower surface of said lower die cavity;

moving an upper movable die structure so that sealing surfaces thereof are moved into engagement with said lower die assembly on opposite sides of said lower die cavity portion to seal said lower die cavity portion and thereby provide a sealed die cavity; and moving said upper movable die structure after said sealing surfaces thereof are moved into engagement with said lower die assembly so as to reduce a size of said sealed die cavity to deform said metallic tube after said die cavity is sealed.

* * * * *